US012102223B2

(12) United States Patent
Singh

(10) Patent No.: US 12,102,223 B2
(45) Date of Patent: Oct. 1, 2024

(54) ACCESS MECHANISM FOR AN INACCESSIBLE INTERIOR OF A CABINET

(71) Applicant: Jasbir Singh, Chandigarh (IN)

(72) Inventor: Jasbir Singh, Chandigarh (IN)

( * ) Notice: Subject to any disclaimer, the term of this patent is extended or adjusted under 35 U.S.C. 154(b) by 20 days.

(21) Appl. No.: 17/609,850

(22) PCT Filed: May 8, 2020

(86) PCT No.: PCT/IB2020/054382
§ 371 (c)(1),
(2) Date: Nov. 9, 2021

(87) PCT Pub. No.: WO2020/225790
PCT Pub. Date: Nov. 12, 2020

(65) Prior Publication Data

US 2022/0211174 A1 Jul. 7, 2022

(30) Foreign Application Priority Data

May 9, 2019 (IN) ..... 201911018632

(51) Int. Cl.
*A47B 46/00* (2006.01)

(52) U.S. Cl.
CPC ..... *A47B 46/00* (2013.01)

(58) Field of Classification Search
CPC ..... A47B 46/00; A47B 81/002
USPC ..... 312/238, 271, 310, 311
See application file for complete search history.

(56) References Cited

U.S. PATENT DOCUMENTS 264,749 A * 9/1882 Potts
3,863,279 A * 2/1975 Stalder ..... A47B 53/00 5/8
4,738,495 A * 4/1988 Mitts ..... A47B 49/006 211/144
5,752,756 A * 5/1998 Compagnucci ..... A47B 49/004 312/238
5,941,620 A * 8/1999 Weber ..... A47B 81/002 312/238
2007/0262682 A1* 11/2007 Gunter ..... A47B 81/002 312/238

(Continued)

FOREIGN PATENT DOCUMENTS

EP 1723875 * 11/2006 ..... A47B 81/00
KR 200441453 Y1 * 8/2008 ..... A47B 77/16

*Primary Examiner* — James O Hansen
(74) *Attorney, Agent, or Firm* — Justin Lampel

(57) ABSTRACT

A cabinet and an access mechanism for the cabinet is disclosed. The cabinet may comprise of a door to access the interior. The door and the adjacent coplanar may be mounted movable jointed combination of first type of frames and second type of frames with telescopic slides and/or guide roller assemblies disposed between to impart the freedom of motion in the desired direction upon a suitable actuation. The first type of frames have been provided with an ability to pivot. The pivots being vertical axillar elements. The arrangement of the two types of frames with pivoted vertical axis provides a plurality of assemblies or shelves mounted on respective door and coplanar portion. The shelves are displaced angularly and laterally owing to the actuating mechanism of the door. The assemblies or shelves are interconnected using coupling elements, horizontal arms and a multiplicity of pivot points arranged at pre-determined distances.

11 Claims, 9 Drawing Sheets

(56) References Cited

U.S. PATENT DOCUMENTS

| | | | | |
|---|---|---|---|---|
| 2008/0122330 | A1* | 5/2008 | Yang | A47B 81/002 312/307 |
| 2009/0051256 | A1* | 2/2009 | Compagnucci | A47B 81/002 312/322 |

* cited by examiner

ACCESS MECHANISM FOR AN INACCESSIBLE INTERIOR OF A CABINET

FIELD OF INVENTION

The present invention relates to an access mechanism, and more specifically to an access mechanism for a cabinet.

BACKGROUND OF THE INVENTION

Conventionally in existing cabinets with multiple shelves, a user is necessarily required to take out the first shelf (or the outer-most shelf) affixed on the door side of the cabinet completely, to access the inner shelf.

Even in the above cases, the inner shelf only remains behind the plane of the cabinet door and the same does not come out. Therefore, the user in such cases cannot access the inner shelf from the exterior of the cabinet.

Thus, a problem associated with the existing cabinets with multiple shelves is that a user has to reach inside the cabinet area to take out things placed in the second shelf.

Another problem associated with the existing cabinets with multiple shelves is that the mechanism of accessing the inner shelf of the cabinet involves a multi-stage process of pulling and sliding of cabinet door, meaning that the user has to pull the cabinet door handle multiple times to access the inner shelf.

A prior art document discloses a mechanism employing two sets of storage shelves, inner and outer, interconnected in such a way so that when the door is pulled out, the inner unit with shelves placed near back wall on other end of the corner unit slides and stops in front of door for access. The user is required to reach inside the cabinet to access the inner shelves As per another prior art document, a mechanism having a heavy duty metallic drawer is disclosed, which slides typically upon the sides of drawers with separating stacked platforms in ninety degree opposition to one another, such that the hidden drawer may be moved laterally into position upon one slide. Then the same drawer, due to the use of heavy duty slides and an intervening platform, may be pulled forward into the position opened by the movement of first drawer, first forward and out of the cabinet, and then to the right on its own set of integrated double slides. This invention has multiple steps involved to pull out the second shelve which is cumbersome and not effective.

Thus, the mechanisms involved in the present day cabinets having multiple shelves require the user to reach out for the shelves located at the rear end of the cabinet and involves multiple steps to be undertaken by the user to access the rear shelves of the cabinet.

OBJECTS OF THE INVENTION

Objects of the present invention involve overcoming the above-mentioned problems associated with the existing cabinets with multiple shelves.

The main object of the present invention is to provide a solution for accessing multiple shelves in a cabinet, especially allowing the user to access the inner (or hidden) shelf of the cabinet easily, without having the user to reach inside the cabinet assembly.

Another object of the present invention is to allow the user to easily access multiple shelves in the cabinet in a one-step action of pulling the cabinet door.

Yet another object of the present invention is to allow the user to easily access multiple shelves in the cabinet, without having the user to perform multiple steps to pull out the inner (or hidden) shelves of the cabinet.

Other objects and advantages of the present invention will become apparent from the following description, taken in conjunction with the appending claims, illustrations and examples to disclose the aspects of the present invention.

SUMMARY OF THE INVENTION

A cabinet having a mechanism to access an inaccessible interior enclosed within said cabinet, comprising a door, a plurality of first type of frames pivoted on a plurality of vertical axis respectively, a plurality of second type of frames movably coupled with the corresponding first type of frames by means of a plurality of telescopic slides, a plurality of coupling elements, a plurality of horizontal arms, a plurality of pivot points, and a door bracket. Coupling of the corresponding second type of frames on the respective first type of frames by means of the telescopic guides provisions for corresponding assemblies comprising shelves, on the door and a coplanar portion of said cabinet respectively. The two assemblies comprising shelves are interconnected with each other by the plurality of coupling elements interspersed with the plurality of horizontal arms and the plurality of pivot points. Initiation of movement of the door of the cabinet enables synchronized angular displacement of the two assemblies comprising shelves, making the assembly located in the inaccessible interior of the cabinet to be accessible from outside the plane of cabinet door.

BRIEF DESCRIPTION OF DRAWING

The present invention will be better understood after reading the following detailed description of the presently preferred aspects with reference to the appended drawings.

DETAILED DESCRIPTION OF THE INVENTION

Figure 1:
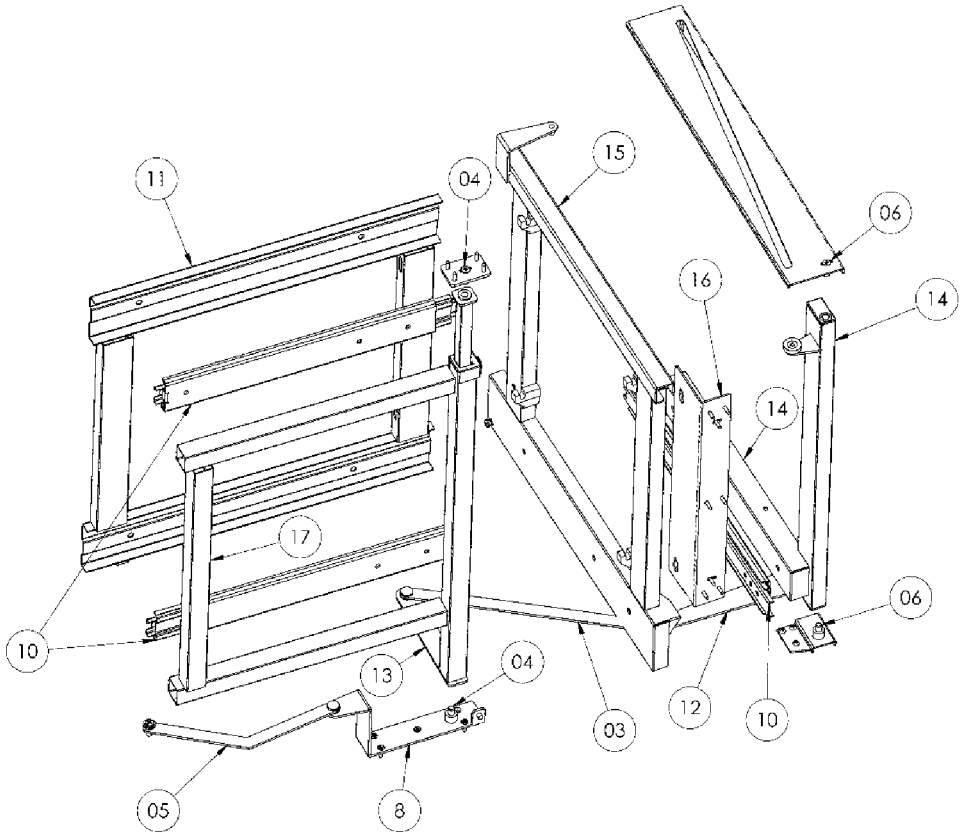
FIG. 1 illustrates an exploded view of the configuration of the cabinet.
Figure 2:
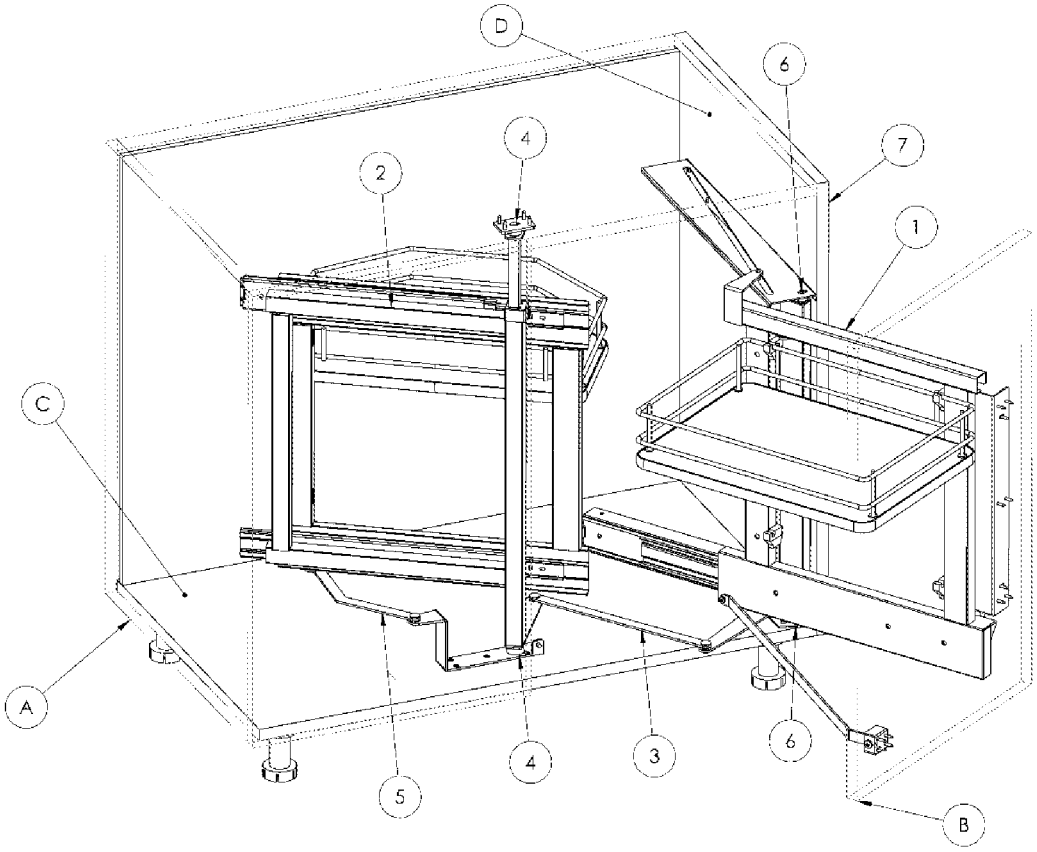
FIG. 2 and FIG. 3 illustrate the inner architecture of the cabinet of the present invention, when the first assembly is displaced out of the cabinet and the second assembly is in the process of being displaced.

These and other features and advantages of the present invention may be incorporated into certain embodiments of the invention and will become more fully apparent from the following description and claims or may be learned by the practice of the invention as set forth hereinafter.

Accordingly, those of ordinary skill in the art will recognize that various changes and modifications of the embodiments described herein can be made without departing from the scope of the invention. In addition, descriptions of well-known functions and constructions are omitted for clarity and conciseness.

Features that are described and/or illustrated with respect to one embodiment may be used in the same way or in a similar way in one or more other embodiments and/or in combination with or instead of the features of the other embodiments.

The terms and words used in the following description and claims are not limited to the bibliographical meanings, but, are merely used to enable a clear and consistent understanding of the invention. Accordingly, it should be apparent to those skilled in the art that the following description of exemplary embodiments of the present invention are provided for illustration purpose only and not for the purpose of limiting the invention.

It is to be understood that the singular forms "a," "an," and "the" include plural referents unless the context clearly dictates otherwise.

It should be emphasized that the term "comprises/comprising" when used in this specification is taken to specify the presence of stated features, integers, steps or components but does not preclude the presence or addition of one or more other features, integers, steps, components or groups thereof.

In accordance with the present invention, a cabinet (A) with multiple shelves has a cabinet door (B) to access the shelves. An interior (C) of the cabinet, which is normally inaccessible in the prior art, is conveniently accessible in the present invention at the front of the cabinet (A) by means of the cabinet door (B).

The cabinet (A) comprises a first assembly (1), a second assembly (2), a plurality of coupling elements (3, 5), a first vertical axis (6), a second vertical axis (4), a plurality of pivot points (9.1, 9.2, 9.3, 9.4), a plurality of telescopic slides (10) and/or guide roller assembly (18) comprising at least one roller coupled to a rolling guide, a plurality of first type of frames (14, 17), a plurality of second type of frames (15, 11), and a plurality of horizontal arms (8, 12,13).

In the cabinet (A), the cabinet door (B) fits over the visible area of the cabinet (A). The visible area of the cabinet (A) is approximately half the exterior-accessible rectangular front area, that extends up to the adjacent perpendicular edge. As the first assembly unit (1) and the second assembly unit (2) are meant to be designed in corners of the cabinet (A), one of the assembly (1) is accessible from the front by means of a door, while the other assembly (2) is inaccessible from its immediate exterior.

As per an alternate embodiment of the present invention, all the shelves in the cabinet (A) are not designed to be placed in the corner, since there might be more than two shelves in the cabinet (A), resulting in one of the shelves to be designed in the middle of the corner shelves.

As per the present invention, the first assembly (1) is mounted on the plane of the cabinet (A), while the second assembly (2) is mounted on the front edge of the plane of the cabinet (A). The first assembly (1) and the second assembly (2) are movably interconnected by means of the first coupling element (3).

Further, as shown in FIG. 1, the first assembly (1) and the second assembly (2) are interconnected in such a way that:

the first assembly (1) has a sliding and pivoting guide so as to slide and swing about the first vertical axis (6). The shelves on the first assembly (1) then move outward towards the exterior of plane of the cabinet door (B), enabling the user to access them; and the second assembly (2) has a sliding and pivoting guide so as to slide and swing on the second vertical axis (4). The shelves on the second assembly (2) then slide outward, bringing said shelves from interior (C) of the cabinet (A) towards the exterior of plane of the cabinet door (B), enabling the user to access them without reaching inside the cabinet (A).

The first vertical axis (6), on which the first assembly unit (1) slides and swings, is fixedly secured at the left or right edge of the cabinet (A). The second vertical axis (4), on which the second assembly unit (2) slides and swings, is fixedly secured 50-120 mm inside the cabinet (A), on the laterally located portion of the cabinet door (B).

In an alternate embodiment of the present invention, the distance of the second vertical axis (4) from the laterally located portion of the cabinet door (B), varies with the size and requirement of the cabinet (A).

Figure 5:
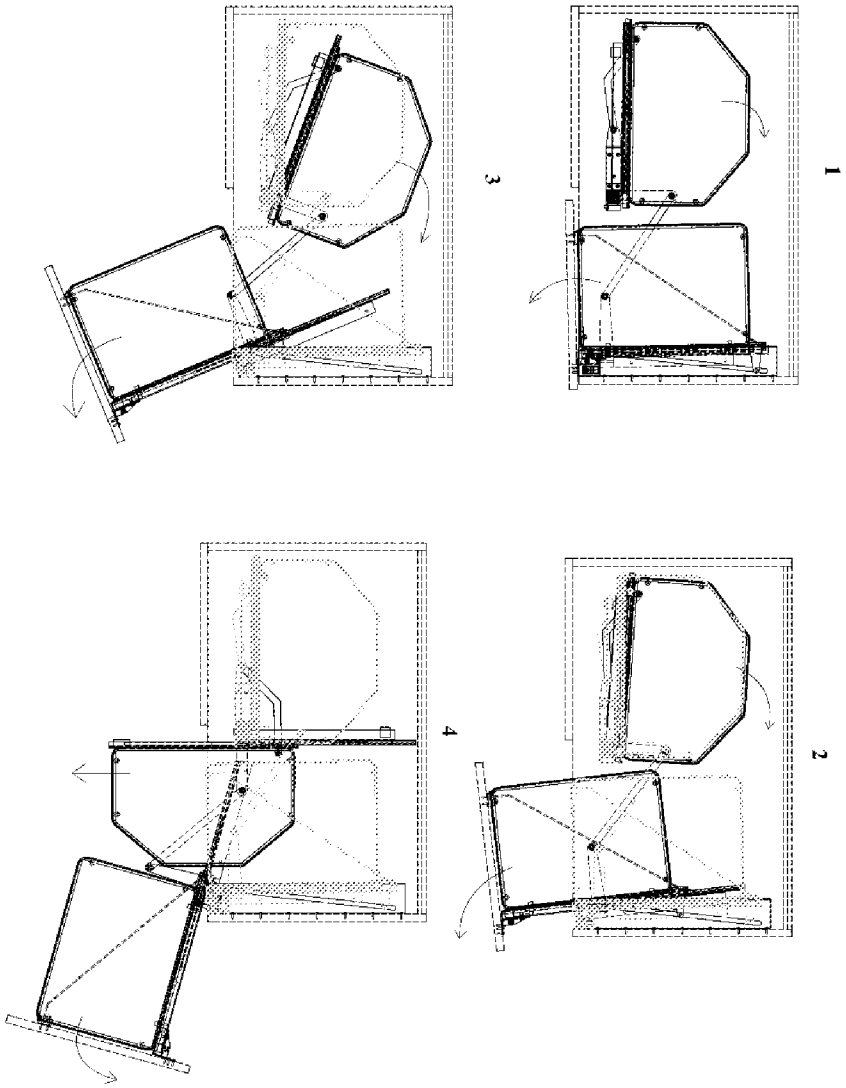
FIG. 5 illustrates a collective top view of the cabinet with the actuating mechanism in four stages of operation, wherein the first assembly opens to the right.
Figure 6:
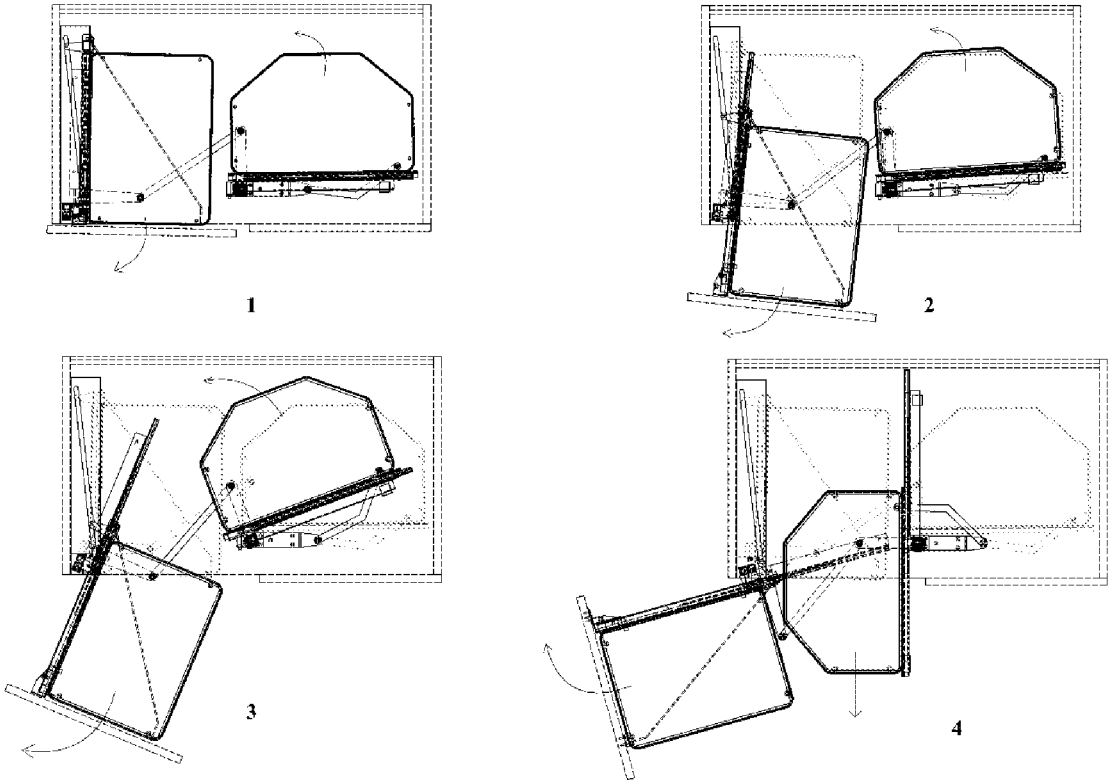
FIG. 6 illustrates a collective top view of the cabinet with the actuating mechanism in four stages of operation, wherein the first assembly opens to the left.

The first assembly (1) is mounted on either left or right side of the cabinet (A), depending on the orientation of the cabinet opening. This is illustrated in FIG. 5 and FIG. 6.

Figure 3:
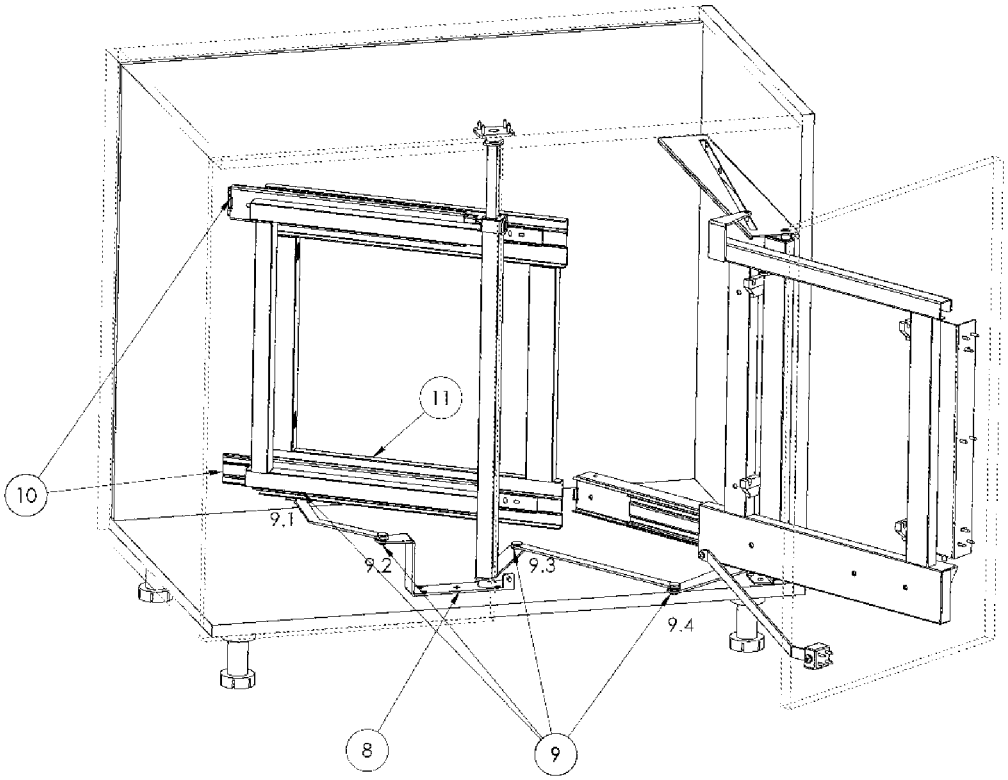
Figure 8:
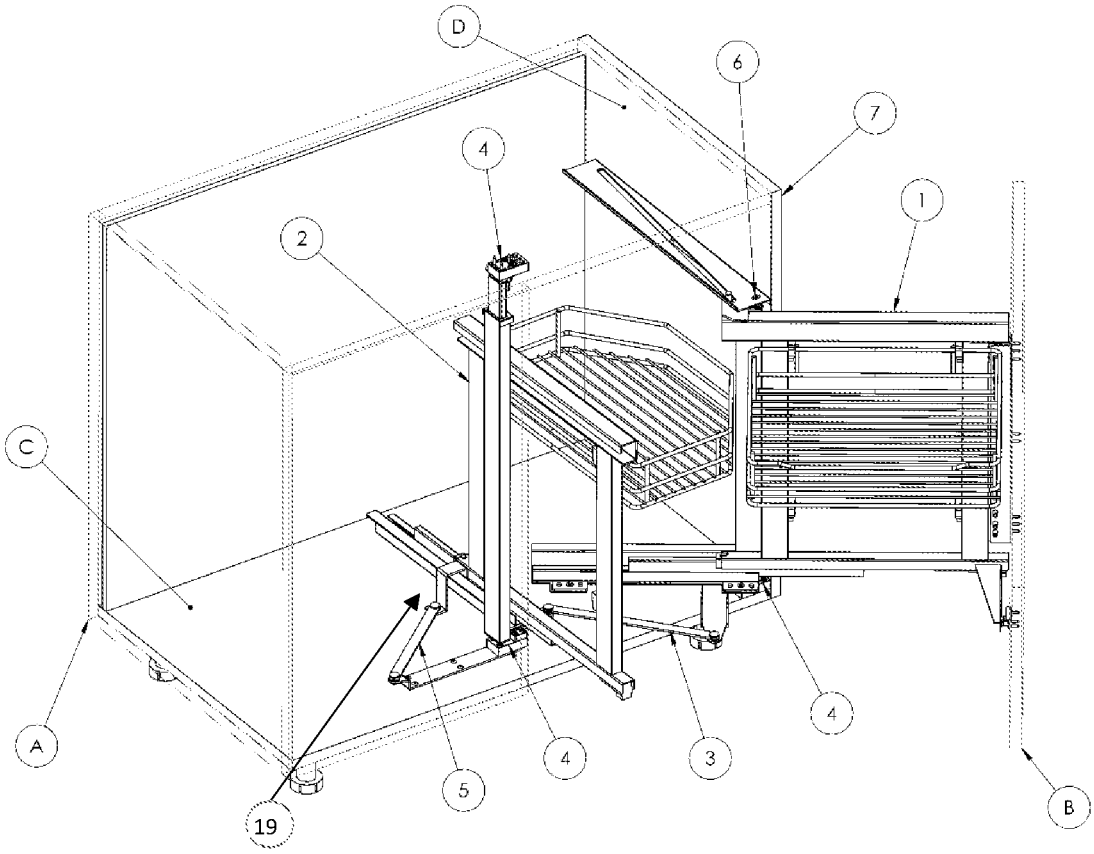
FIG. 8 illustrates the inner architecture of the cabinet of the present invention according to the alternative embodiment of the present invention, when the first assembly is displaced out of the cabinet and the second assembly is in the process of being displaced.
Figure 9:
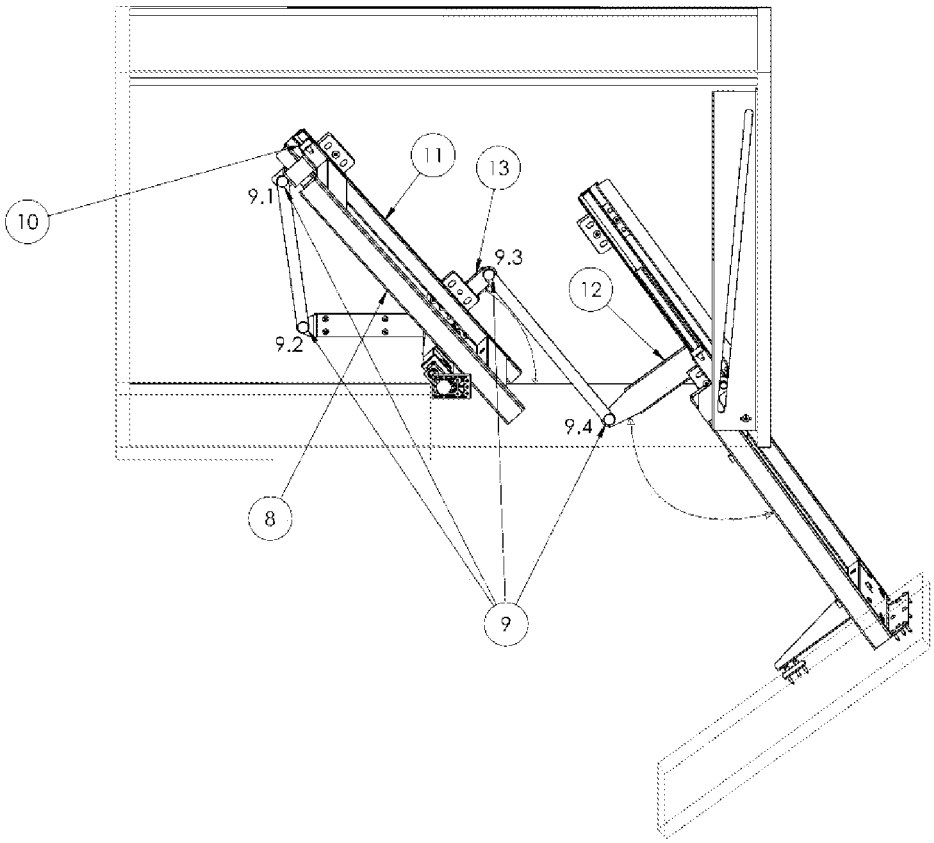
FIG. 9 illustrates a top view of the cabinet with the actuating mechanism according to the alternative embodiment of the present invention, wherein the first assembly opens to the right.

The second coupling element (5) is connected to the bottom of the rear of second assembly (2) on one side. In a first embodiment, the second coupling element (5) is directly attached to the bottom of the movable frame 11 of assembly 2 (FIG. 3). In an alternate embodiment, the second coupling element (5) is connected to a bracket (19) fixed to the bottom of frame 11 by means of a pivot point (9.1) as shown in FIG. 8. As shown in FIG. 3, the second coupling element (5) is also connected to one of the pivot points (9.2) proximate to the plane of the door of cabinet (B), at a suitable proximal distance from the second vertical axis (4) on the inner side of the cabinet (A), which results in pivotal movements.

In an alternate embodiment, the second coupling element (5) on one side is pivotally connected to a bracket (19) fixed at the rear end of the movable frame 11 of the second assembly (2) by means of a pivot point (9.1) and to the pivot point (9.2) on the other side proximate to the plane of the door of cabinet (B) as shown in FIG. 8.

The first coupling element (3) is coupled on either side with the plurality of horizontal arms (12, 13), as is illustrated in FIG. 1, FIG. 2, FIG. 8 and FIG. 9. Horizontal arm 13 is fixedly attached to bottom of frame (17) at one end and to the pivot point (9.3) on the other hand. Similarly the horizontal arm (12) is fixedly connected to bottom of frame (14) at one end and to the pivot point (9.4) on the other hand as shown in FIG. 3. One of the plurality of the horizontal arms (8) is also coupled with the second coupling element (5) either directly or by means of a bracket.

Figure 4:
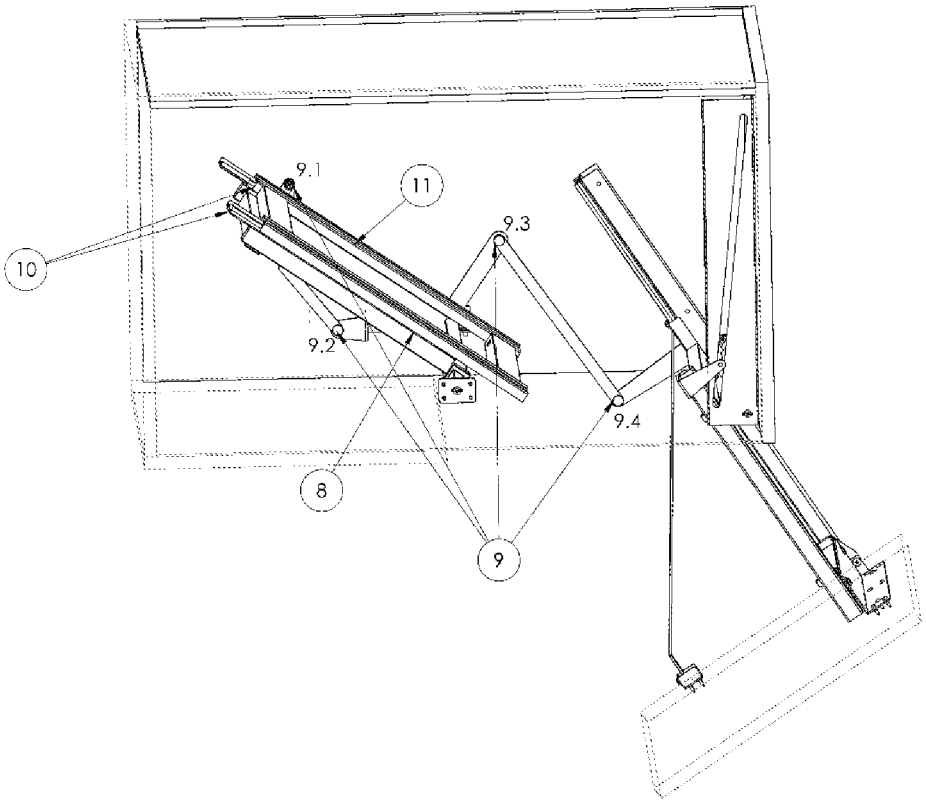
FIG. 4 illustrates a top view of the cabinet with the actuating mechanism.

FIG. 4 illustrates the fixed coupling of the plurality of horizontal arms (12, 13) with the first type frames (14, 17). This connection between the plurality of horizontal arms (12, 13), the first and second coupling elements (3, 5), and the first type of frames (14, 17) result in the angular movement of the two assemblies (1, 2), which is again well illustrated in FIG. 4.

It is essential to understand that in the present invention, at the initiation stage of mechanism, one of the plurality horizontal arms (12) is configured to be parallel to the plane of the cabinet door (B). The other horizontal arm (13) is configured to be approximately perpendicular to the plane of the cabinet door (B), specifically in an angular range of 80°-100°.

Once the first assembly unit (1) fixed to the cabinet door (B) is pulled out by means of the cabinet door (B), the first coupling element (3) actuates the second assembly unit (2) to angularly displace outwards on the second vertical axis (4). As the second assembly unit (2) starts to move on the second vertical axis (4), the second coupling element (5) pushes the frame (11) carrying the shelves outwards. The shelves are mounted on the frame (11), movably connected with the frame (17) on the second assembly unit (2) with a pair of telescopic slides (10) (refer to FIG. 1) or a combination of telescopic slide at the bottom and a guide roller assembly on top of the movable frame 11, wherein the guide roller assembly comprises at least one roller configured to move within a guide rail (refer to FIG. 7).

Figure 7:
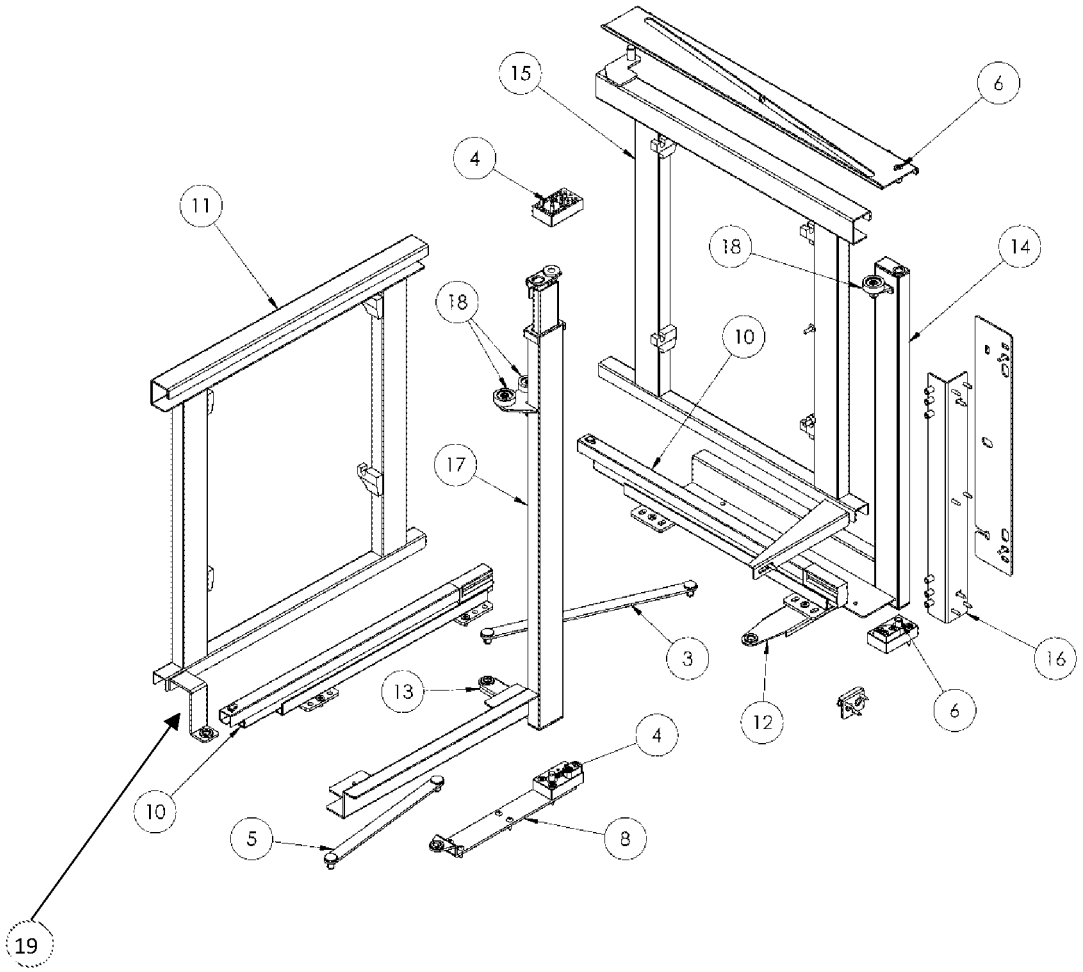
FIG. 7 illustrates an exploded view of the configuration of the cabinet according to an alternative embodiment of the present invention.

The frame (11) is movably connected to the frame (17) by means of at least one telescopic slide (10). In one embodiment, there are two telescopic side mounting slides (10) to connect frame (11) and frame (17) as shown in FIG. 1. In an alternate embodiment, the frames (11) and (17) are connected by one telescopic undermount slide and one rolling assembly on the opposite side of the frames as shown in FIG. 7. The rolling assembly comprises at least one roller (18) fixedly attached to the frame (17) and configured to move inside the rolling guide mounted on the frame (11) while pivoting around the second vertical axis (4). FIG. 7, for instance, illustrates a pair of rollers fixed on frame (17). The guide roller (18) assembly is installed for smooth movement of the second assembly (2) around the second vertical pivot axis (4) as illustrated by FIG. 8 according to the alternate embodiment of the present invention Similarly, the frame (14) is movably connected to the frame (15) by means of at least one telescopic slide (10). The telescopic slides (10) used to connect the frames may be selected from the side mounting slides, for instance, side mounted ball bearing slides as shown in FIG. 1. In an alternate embodiment, the telescopic slide is a undermount slide as shown in FIG. 8. The guide roller (18) assembly is installed for smooth movement of the first assembly (1) around the first vertical pivot axis (6) as illustrated by FIG. 8 according to the alternate embodiment of the present invention.

It is understood by a person skilled in the art that the mechanism used in the cabinet with multiple shelves of present invention is applicable for cabinets and shelves with rectangular configurations.

The mechanism as per the present invention therefore, enables the user to access the inaccessible interior (C) on the outside of the plane of cabinet door (B), without requiring the user to reach inside the cabinet.

The opening or closing (pulling or pushing) of the cabinet door (B) opens and closes all the shelves in the cabinet (mounted on the door side, at the middle of the cabinet, and at the interior-most corner of the cabinet) in a one-step action, making all the shelves easily accessible to the user. The mechanism of the present invention thus, provides a one-step solution for sliding out the inaccessible interior (C) to the exterior of the cabinet.

As per another alternate embodiment of the present invention, when the second coupling element (5) is disengaged from the second assembly (2), the shelves therein only angularly pivot on the vertical axis (4) and stop at the edge of the plane of cabinet door (B). Pursuant to this in a following step, the shelves on second assembly (2) can be manually pulled out by the user towards the outside of the plane of cabinet door (B).

Although the embodiments herein are described with various specific embodiments, it will be obvious for a person skilled in the art to practice the invention with modifications. However, all such modifications are deemed to be within the scope of the invention and claims.

The invention claimed is:

1. A cabinet (A) employing a mechanism to access an inaccessible interior (C) enclosed within said cabinet (A), comprising:

i a door (B);

ii a plurality of first type of frames (14, 17) pivoted on a plurality of vertical axis (6, 4) respectively;

iii a plurality of second type of frames (15, 11) movably coupled with the corresponding first type of frames (14, 17) by means of a plurality of telescopic slides (10) and a plurality of guide roller assemblies;

iv a plurality of coupling elements (3, 5);

v a plurality of horizontal arms (12, 13); vi a plurality of pivot points (9.1, 9.2, 9.3 and 9.4); and vii a door bracket (16), wherein a first assembly mounted on the door (B) of the cabinet (A), the first assembly comprising one of the first type of frames (14) movably coupled to one of the second type of frames (15) by means of one of the telescopic slides (10), shelves mounted on the second type of frames (15), said first assembly having a sliding and pivoting guide to slide and swing about a first vertical axis (6);

a second assembly comprising another of the first type of frames (17) movably coupled to another of the second type of frames (11) by means of the telescopic slides (10), shelves mounted on the second type of frame (11), said second assembly having a sliding and pivoting guide to slide and swing about a second vertical axis (4);

the first assembly (1) and the second assembly (2) are interconnected by the plurality of coupling elements (3, 5) wherein one of the horizontal arms (12) is connected to a bottom of the first assembly (1) and another of the horizontal arms (13) is connected to a bottom of the second assembly (2) of the cabinet, and wherein the plurality of coupling elements (3, 5) connect the plurality of horizontal arms (12, 13) at the plurality of pivot points (9.1, 9.2, 9.3 and 9.4);

wherein the first assembly moves from a first position to a second position and wherein the door (B) of the cabinet is in a closed position when the first assembly is in the first position, and the door (B) of the cabinet is in an open position when the first assembly is in second position;

wherein the second assembly moves from a first position to a second position wherein the second assembly is completely located within the interior of the cabinet in the first position and is inaccessible and wherein the second assembly is not completely located within the interior of the cabinet in the second position and is accessible;

wherein, initiation of movement of the door (B) of the cabinet (A) from the first position to the second position enables synchronized angular displacement of the first assembly (1) and the second assembly (2), making the inaccessible second assembly (2) located completely within the interior of the of the cabinet (A) to be accessible and at least partially located outside of the cabinet when the second assembly is in the second position; and wherein a portion of the second assembly partially moves past the first position of the door (B) when the second assembly moves from the first position to the second position.

2. The cabinet (A) as claimed in claim 1, wherein when a second coupling element (5) is disengaged from the second assembly (2), the shelves get manually pulled out by a user towards the outside of a plane of the cabinet door (B) after the shelves angularly pivot on the second_vertical axis (4).

3. The cabinet (A) as claimed in claim 1, wherein one of the plurality of first type of frames (14), movably coupled to one of the corresponding plurality of second type of frames (15) by means of one of the telescopic slides (10) or a combination of a telescopic slides and one of the plurality of guide roller assemblies (18), is mounted on one of the plurality of pivoting axis (6), to enable the first assembly (1) to angularly move 90 degrees approximation opposite to the direction of the inaccessible interior (C) of the cabinet (A) due to displacement of one of the plurality of second type of frame (15) from the interior of cabinet to the exterior, when the cabinet door (B) attached to said second type of frame (15) is pulled.

4. The cabinet (A) as claimed in claim 1, wherein another of the plurality of first type of frames (17), movably coupled to another of the second type of frames (11) by means of the pair of telescopic slides (10) or a combination of a telescopic slides and one of the plurality of guide roller assemblies (18), is mounted on the corresponding second vertical axis (4), to enable the second assembly (2) to angularly move 90 degrees to the direction of said second vertical axis (4).

5. The cabinet (A) as claimed in claim 1, wherein one of the plurality of pivot points (9.2) is at a distance of 120-200 mm towards the inaccessible interior (C) of the cabinet (A) from the second vertical axis (4).

6. The cabinet (A) as claimed in claim 1, wherein one of the plurality of coupling elements (3) is disposed between two of the plurality of pivot points (9.3 and 9.4).

7. The cabinet (A) as claimed in claim 1, wherein one of the plurality of coupling elements (5) is disposed between two of the plurality of pivot points (9.1 and 9.2).

8. The cabinet (A) as claimed in claim 1, wherein the second vertical axis (4), on which the second assembly (2) slides and swings, is fixedly secured at a distance of 50-120 mm inside the cabinet (A), from a front edge of said cabinet (A).

9. The cabinet (A) as claimed in claim 1, wherein the first vertical axis (6), on which the first assembly (1) slides and swings, is fixedly secured at either edge of the cabinet (A).

10. The cabinet (A) as claimed in claim 1, wherein one of the plurality of coupling element arms (5) provides pulling and pushing movements to one of the plurality of second type of frame (11) of the second assembly (2).

11. The cabinet (A) as claimed in claim 1, wherein the plurality of telescopic slides are selected from side mounted ball bearing slides or undermount slides.

* * * * *